United States Patent [19]

Weibel

[11] Patent Number: 4,567,988

[45] Date of Patent: Feb. 4, 1986

[54] APPARATUS AND METHOD FOR SORTING AND DISTRIBUTING OBJECTS

[75] Inventor: Clemens Weibel, Bossiere, France

[73] Assignee: Eastman Kodak Company, Rochester, N.Y.

[21] Appl. No.: 487,924

[22] Filed: Apr. 22, 1983

[51] Int. Cl.[4] ..... B07C 5/00

[52] U.S. Cl. ..... 209/564; 209/583; 209/569; 209/698; 209/933

[58] Field of Search ..... 434/134; 209/576, 583, 209/584, 569, 577, 933, 563–566, 698; 198/575, 576, 368, 370, 464, 349

[56] References Cited

U.S. PATENT DOCUMENTS

| | | | |
|---|---|---|---|
| 3,282,392 | 11/1966 | Fowler | 198/576 |
| 3,298,499 | 1/1967 | Ellis et al. | 198/576 X |
| 3,348,359 | 10/1967 | Lasbrey | 53/493 |
| 3,645,391 | 2/1972 | Hirakawa et al. | 209/583 |
| 3,696,946 | 10/1972 | Hunter et al. | 414/134 |
| 3,789,571 | 2/1974 | Tall et al. | 53/54 |
| 3,895,716 | 7/1975 | Ugo | 209/583 |
| 3,904,516 | 9/1975 | Chiba et al. | 209/583 |
| 3,930,995 | 1/1976 | Paddock et al. | 209/698 |
| 4,058,217 | 11/1977 | Vaughan et al. | 209/583 |
| 4,114,349 | 9/1978 | Jensen et al. | 53/493 |
| 4,249,663 | 2/1981 | Hewlett | 209/689 X |
| 4,271,967 | 6/1981 | Matsuo et al. | 209/558 |
| 4,303,503 | 12/1981 | de Mimerand et al. | 209/3.3 |
| 4,310,276 | 1/1982 | Castagnoli | 209/583 |
| 4,358,016 | 11/1982 | Richardson et al. | 209/583 |

FOREIGN PATENT DOCUMENTS

| | | | |
|---|---|---|---|
| 3010213 | 10/1980 | Fed. Rep. of Germany | 209/583 |
| 588900 | 6/1977 | Switzerland | 209/583 |

*Primary Examiner*—Robert B. Reeves
*Assistant Examiner*—Glenn B. Foster
*Attorney, Agent, or Firm*—William C. Dixon

[57] ABSTRACT

In a system for conveying objects bearing indicia of destination addresses to associated receptacles, the indicium on each object is converted to an address code identifying a particular receptacle, and the code is fed to a control device for storage. The objects are then moved sequentially past a meter which reads and feeds their indicia to the control device and counts the objects as they pass on to a succession of uniformly spaced containers traveling in a continuous, closed path near the receptacles. All objects passing the meter thus become associated with respective containers, and their number equals the number of containers sequentially passing an arbitrary metering point along the closed path. Any container carrying an object reaches a point over its target receptacle when the meter count for that object corresponds to the indicium/address code which associates that object with that receptacle. The control device then issues a command signal causing that container to release its object for delivery to the designated receptacle.

5 Claims, 4 Drawing Figures

APPARATUS AND METHOD FOR SORTING AND DISTRIBUTING OBJECTS

BACKGROUND OF THE INVENTION

1. Field of the Invention

The present invention relates generally to an arrangement for sorting addressed objects and distributing them to receptacles associated with the addresses designated. More particularly, the invention relates to an apparatus and method for sorting addressed order bags loaded with photographic material and distributing such bags to receptacles associated with specified customers or dealers.

2. Description of the Prior Art

U.S. Pat. No. 4,310,276 discloses apparatus for sorting objects having various destinations. The apparatus comprises a circulating continuous conveyor path having on both sides thereof a plurality of movable containers. Each container comprises several individual compartments that have an open top and an openable bottom. The containers are spaced randomly and are movable independently of one another along the conveyor path.

At a loading station the constituent compartments of each container are loaded with the objects to be sorted through their open tops. The containing comprising those compartments is then moved along the conveyor path to a sorting station, where the objects are released from the compartments, via their openable bottoms, to underlying removable receptacles associated with the intended destinations of those objects.

The loading station includes a coding facility at which an operator marks the objects to be sorted and feeds pertinent sorting data to a corresponding control unit. From there, the marked objects are first advanced transversely, relative to the conveyor path, by a plurality of moving conveyor belts, and are then moved longitudinally, by a system of driven rollers, into a pivotable chute adapted to convey each object individually to an awaiting container compartment therebelow.

The container, with its loaded compartments, is then moved along the conveyor path to a sorting station, as mentioned above. When a loaded compartment arrives above its corresponding destination receptacle at the sorting station, the control unit actuates an actuation member associated with that compartment in order to open its bottom and release the object therein to the underlying receptacle.

While such prior apparatus may be satisfactory in some applications, there has remained a need for an improved sorting and distributing arrangement which is more adaptable to use with increasingly greater numbers of destinations, an arrangement that ensures a higher sorting and distributing efficiency, and which operates more simply and reliably, and at a low noise level.

SUMMARY OF THE INVENTION

The foregoing need is fully met by the present invention, which provides an improved sorting and distributing arrangement wherein:

a continuous conveyor means is preceded by at least one conveyor belt for advancing addressed objects originating from one or more pricing and loading stations;

the conveyor belt is provided with a succession of uniformly spaced compartments;

the continuous conveyor means is provided with a succession of uniformly spaced transport containers;

the speeds of movement of the conveyor belt and the continuous conveyor means are synchronized so that each compartment on the conveyor belt is sequentially associated with a particular transport container on the continuous conveyor means, each transport container being associatable with any one of a plurality of destination receptables disposed in object-receiving relationship to the continuous conveyor means;

a reading and metering device is provided for reading the address of each object and for counting the number of compartments passing the device; and an electronic control device is provided to affect each transport container upon reaching its associated destination receptacle so that an object transported by that container can be conveyed automatically to that receptacle.

With such an improved arrangement, objects can be readily sorted and distributed to a large number of destinations, efficiently, reliably, and with little operational tediousness.

According to the invention, the speeds of the conveyor belt and the continuous conveyor means can be controlled electronically so that the number of compartments on the conveyor belt passing the reading and metering device equals the number of transport containers on the continuous conveyor means passing an arbitrary metering point. The specific locations along the continuous conveyor means at which the transport containers are disposed above their targeted destination receptacles can thus be determined by a simple counting process carried out by the reading and metering device.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, wherein like reference numerals denote like elements and wherein.

DESCRIPTION OF THE PREFERRED EMBODIMENT

Because certain parts of sorting and distributing apparatus as well known, the following description is directed in particular to those elements forming, cooperating directly with, or relating to the present invention. Elements not specifically shown or described herein are selectable from those known in the relevant art.

Figure 1:
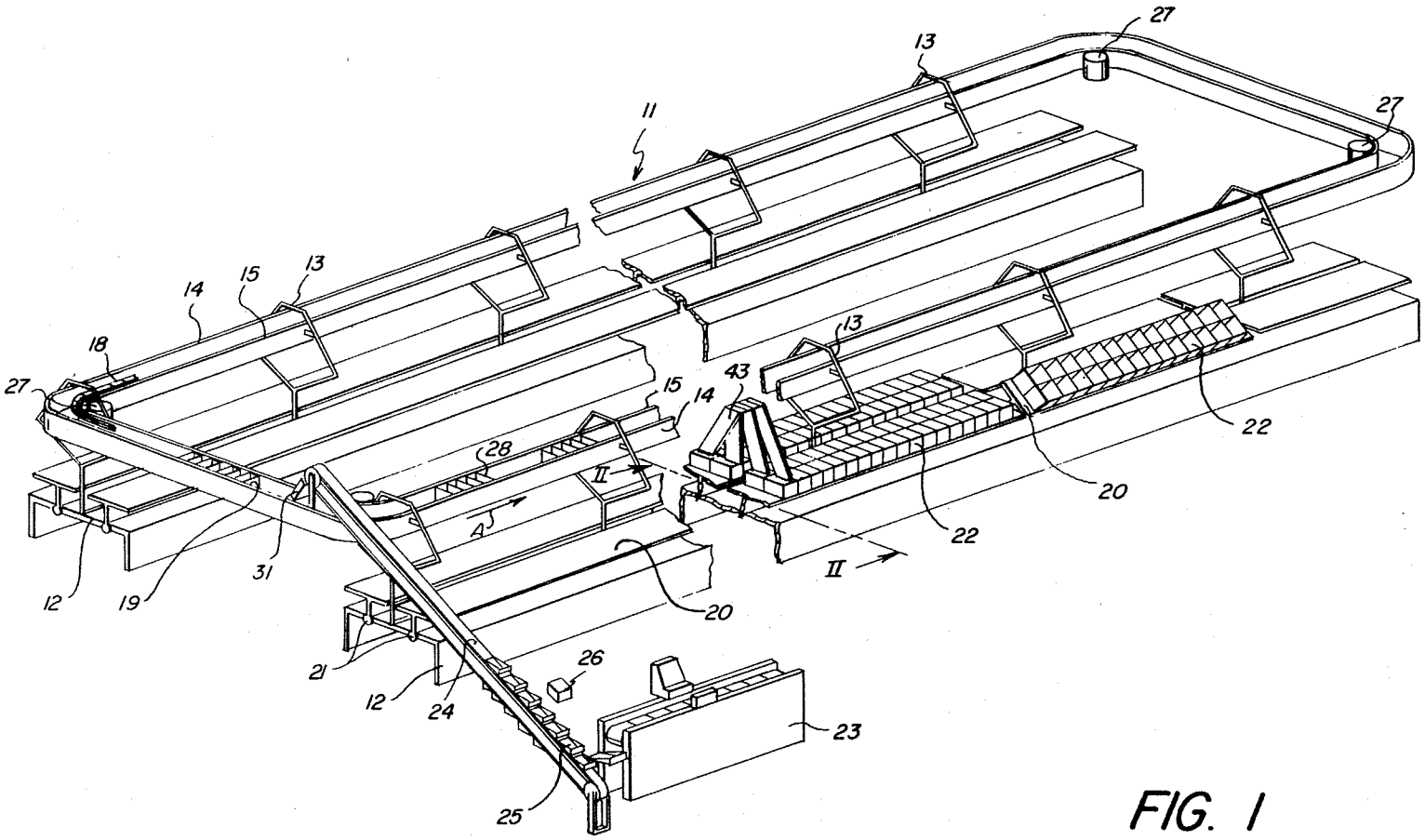
FIG. 1 is a perspective view, in schematic form, of apparatus for sorting and distributing objects in accordance with the preferred embodiment of the present invention.
Figure 2:
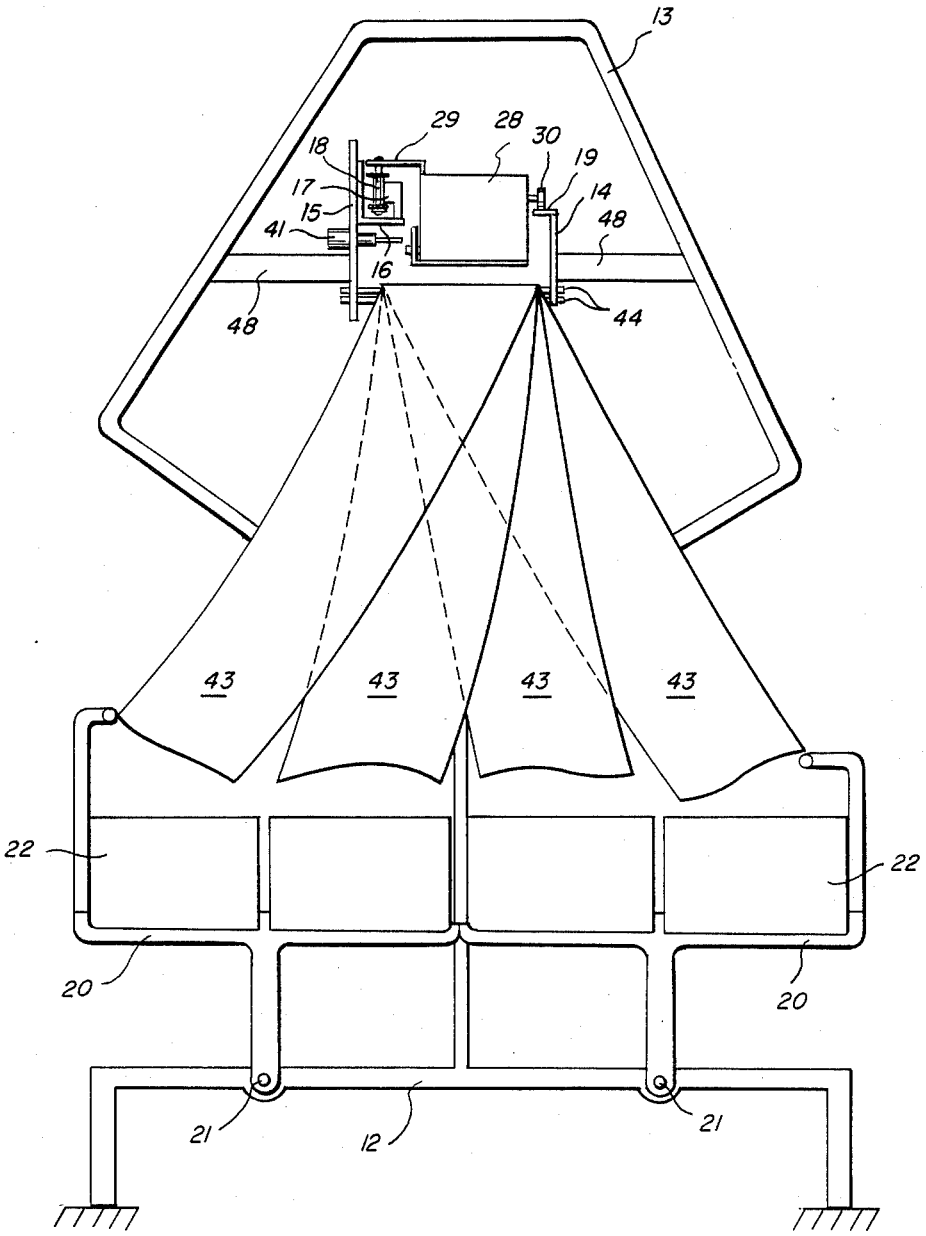
FIG. 2 is a sectional view taken along line II—II of FIG. 1.
Figure 3:
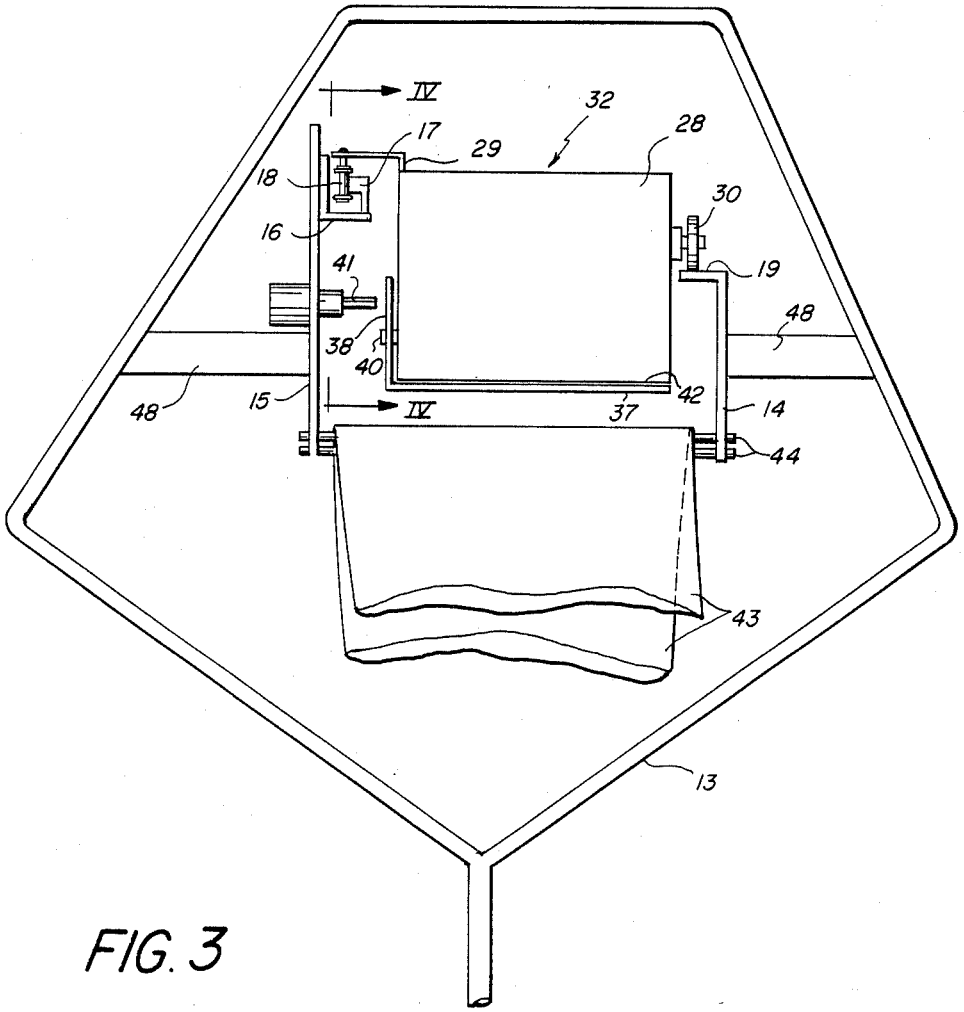
FIG. 3 is an enlarged fragmentary section showing, in greater detail, a portion of the apparatus as viewed in FIG. 2.

The sorting and distributing apparatus shown in FIG. 1 comprises an upside-down-U-shaped frame 11 with two parallel supporting sections extending horizontally at the bottom. Each of those supporting sections has a base structure 12 on which are mounted a series of crossbars 13 extending vertically upward.

Secured to crossbars 13, by rods 48, are a pair of parallel guiding tracks 14 and 15, which extend horizontally so as to form a continuous, closed, substantially rectangular loop (as viewed from above). Fixed to guiding track 15 is a support 16 with a friction bearing 17 thereon for supporting and guiding a continous conveyor chain 18. Chain 18 is driven by one or more motors 27. On guiding track 14 is a flange 19 which projects toward opposing track 15 as shown.

Disposed beneath tracks 14 and 15 are several horizontally aligned support frames 20, each configured to accomodate a plurality of destination receptacles 22. Support frames 20 are pivotally mounted on base structure 12 so that they may be tilted outwardly about their respective pivots 21 to facilitate access to receptacles 22.

Adjacent to frame 11 is a pricing and loading station, or location, 23. Although only one is shown, several such stations could be provided to cooperate simultaneously with the other components of the storing and distributing apparatus herein described.

Extending from the output end of station 23 to a site above guiding tracks 14 and 15 is a conveyor belt 24. Conveyor belt 24 is provided with a succession of uniformly spaced compartments, or stages, 25 which move past a reading and metering device 26 at a speed that is synchronized with the speed of conveyor chain 18.

Conveyor chain 18 is provided with a succession of uniformly spaced transport containers, or stations, 28. Projecting from each container 28 is an arm 29 which is screwed to chain 18. Rotatably mounted at the opposite side of container 28 is a wheel 30 which is supported for rolling movement on flange 19.

Figure 4:
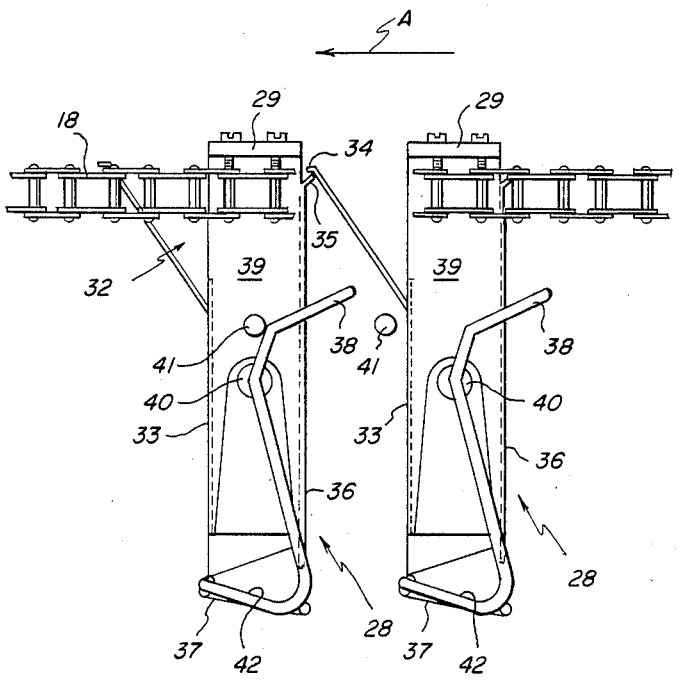
FIG. 4 is an enlarged fragmentary sectional view taken along line IV—IV of FIG. 3.

In the illustrated embodiment, the length dimension of almost three transport containers 28, measured in the direction of advance (shown by arrow A in FIGS. 1 and 4), is equal to the corresponding dimension of only one destination receptable 22. Receptacles 22 are therefore arranged next to each other transversely with respect to the advance direction.

As pointed out above, the speeds of movement of belt 24 and chain 18 are synchronized so that each compartment 25 is sequentially associated with a particular container 28, and the number of compartments 25 passing reading and metering device 26 corresponds exactly to the number of containers 28 passing an arbitrary metering point. Also, objects carried by compartments 25 are reliably conveyed in sequence to containers 28 via a slide 31 disposed at the aforementioned site above tracks 14 and 15.

At the top of each container 28 is a widened input opening 32 formed in part by the forwardly inclined upper portion of its front wall 33. Said upper portion terminates in a forwardly projecting flange 34 which overlaps the rearwardly inclined top portion 35 of rear wall 36 of the immediately preceding container. This arrangement ensures both a large input opening 32 for each container 28 and a continuous succession of such containers, so that objects conveyed via compartments 25 and slide 31 can be dropped reliably and safely into their intended containers.

Each container 28 has a bottom 37 that can be flipped open. Bottom 37 is disposed on the lower arm of a two-arm lever 38, which is pivotally mounted, by a pin 40, on the container side wall 39 that faces chain 18. The upper arm of lever 38 extends into the area of an electromagnetically actuatable plunger 41 mounted on guiding track 15. Bottom 37 may comprise a plate which closes output opening 42, or, as in the illustrated embodiment, it may comprise a meandering extension of the lower arm itself. Bottom 37 is inclined in such a way that its rear edge is lower than its front edge. Because both the upper portion of front wall 33 and bottom 37 are so inclined, any object carried in container 28 likewise assumes an inclined orientation and is thereby positioned for ready release through opening 42.

Means for directing, or guiding, objects so released from containers 28 to their intended receptacles 22 are provided in the form of a plurality of flexible conduits 43 disposed in close succession beneath guiding tracks 14 and 15. Each conduit is hingedly suspended at its open top end by a pair of tranversely extending elastic rods 44 coupled to tracks 14 and 15. The four rods 44 for each pair of conduits 43 that hang adjacent to and face each other are arranged in such a way that the two of those rods closest to each other are located one above the other, thereby precluding any gap between succeeding conduits through which objects released from containers 28 might otherwise fall. Conduits 43 are thus arranged in gapless sequence so that all objects to be distributed can be reliably delivered to the destination receptacles 22 determined for them. The open bottom ends of conduits 43, which extend toward receptacles 22, are adjustably connected to frame 11 in order to maintain each such end in accurate alignment with its targeted receptacle.

The operation of the above-described apparatus will now be explained with reference to its use for sorting and distributing photographic customer orders such as developed films, print orders, and the like.

The entire apparatus is electronically controlled by one or more microprocessors. Each of the destination receptacles 22 is associated with a certain customer and has a specific sequential location in the apparatus that corresponds to a particular customer number which is stored in the form of an address code in the microprocessor.

Objects in the form of order bags, filled with pictures upon completion of a customer order, are supplied to the pricing and loading station 23. At station 23 the customer number, already imprinted on the order bag, is first read and recorded, or converted, into an address code corresponding to a specific destination receptacle 22. That address code is then fed to the microprocessor and stored there in the form of a storage stack, while the order bag itself is transferred to one of the compartments 25 on conveyor belt 24.

As the bag then passes reading and metering device 26, its customer number is again read and fed to the microprocessor. Device 26 represents a zero position for each passing bag. To the microprocessor this means that the customer number of a passing bag, e.g., "X", which corresponds to the address code of an associated destination receptacle 22, is at the zero position. Device 26 then begins to count additional passing compartments 25.

When "X" number of compartments have been so counted, the transport container 28 carrying order bag "X" is exactly above the particular destination receptacle 22 specified for that customer. At that moment, the microprocessor releases a circuit pulse to the electromagnetically actuatable plunger 41 associated with the underlying receptacle 22. The pulse causes that plunger 41 to move into the movement path of, and block, the lever 38 on container 28 bearing bag "X", thereby causing lever 38 to pivot about pin 40 and thus open bottom 37 thereon. Bag "X" then falls through opening 42, into and through the immediately underlying circuit 43, and thence into the intended receptacle 22.

In this simple, convenient, and reliable manner, order bags can be conveyed automatically to their intended customer destination receptacles. To facilitate removal of order bags from those receptacles, the receptacles are set in a support frame which can be tilted outwardly, as already explained. The contents of those receptacles, or the receptacles themselves, can then be removed easily.

The arrangement of customer destination receptacles 22 beneath conveyor chain 18 and transport containers 28 as shown is extremely space-saving. In relatively little floor space, such apparatus can be installed with a large number of destination receptacles. For example, the embodiment illustrated herein provides 1,536 receptacles, and the speed of its conveyor chain 18 is such that approximately 6,000 orders per hour can be efficiently distributed. A significant advantage of this arrangement is that it can be expanded as desired. Only the driving force of the motors driving the conveyor chain need be adapted.

Another advantage is that the low speed of the conveyor chain contributes to a relatively low level of chain noise and a concomitant improvement in working conditions.

Finally, at the end of each cycle of conveyor chain movement, an optical control device is operative to detect any order bag not ejected from or stuck in its container, and another control device is operative, when such a bag is detected, to stop the conveyor chain so that the errant bag can be retrieved rather than recycled.

AN ALTERNATIVE EMBODIMENT

In an alternative embodiment of the present invention, wherein distribution performance can be further improved, the frame 11 is provided with a second continuous conveyor means parallel with conveyor means 18. Suspended beneath the two parallel conveyor means, in lieu of conduits 43, are a plurality of flexible Y-shaped conduits. Each such conduit has two input openings at the top for receiving objects released from the transport containers of the two conveyor means, respectively, and one output opening at the bottom for directing those objects to the targeted destination receptacle 22 therebelow. With such an arrangement, objects can be released from the transport containers of the two conveyor means either alternately or simultaneously for efficient delivery through the Y-shaped conduits in their intended destination receptacles.

The invention has been described in detail with particular reference to the preferred embodiment and an alternative embodiment thereof, but it will be understood that further variations and modifications can be effected within the spirit and scope of the invention.

What is claimed is:

1. Apparatus for sorting objects bearing indicia of respective destination addresses and for distributing said objects to receptacles associated with said addresses, said apparatus comprising:

electronic control means for receiving, storing, processing, and issuing information signals;

converting means for converting each of said indicia into a corresponding address code identifying a specific one of said receptacles and for feeding said code as one of said signals to said control means for storage;

reading and metering means for reading each of said indicia when each of said objects is in a position of alignment therewith, for feeding each of said indicia, when read, as another of said signals to said control means, and for counting succeeding ones of said objects when each is in said position of alignment;

conveying means drivable for conveying said objects at uniformly spaced stages thereon in sequence past said reading and metering means through said position of alignment;

transporting means drivable for transporting said objects at uniformly spaced stations thereon in said sequence from said conveying means along a continuous closed path, said receptacles being successively arranged in object-receiving relationship to said path, each of said receptacles being associatable with any one of said stations;

said conveying means including a first conveyor having an input end disposed in object-receiving relationship to said converting means, an output end disposed in object-delivering relationship to said transporting means, and a portion intermediate said ends disposed near said reading and metering means, said stages including distinct compartments on said first conveyor for receiving respective ones of said objects successively supplied thereto at said input end and for supporting each of said objects, so received, successively in said position of alignment as said objects are conveyed, by said first conveyor, in said sequence past said reading and metering means toward said output end;

delivering means near said output end for delivering said objects, conveyed by said first conveyor, in said sequence from said conveying means to said transporting means;

directing means disposed along said path, including successive portions thereof extending from said transporting means respectively toward corresponding ones of said receptacles, for directing each of said objects from its particular station in said transporting means to a specific one of said receptacles determined to be associated with that station, when said station reaches a position adjacent to the one of said directing means portions extending from said transporting means toward said specific receptacle;

driving means for driving said conveying means and said transporting means at respective speeds so synchronized that each of said stages on said conveying means is sequentially associated with a particular one of said stations on said transporting means, and the number of said stages sequentially passsing through said position of alignment with said reading and metering means equals the number of said stations sequentially passing an arbitrary metering point along said path, whereby any one of said stations transporting one of said objects along said path reaches a position adjacent to the one directing means portion extending from said transporting means toward the specific receptacle associated with that station at a time determinable by counting the number of said objects passing through said position of alignment with said reading and metering means after said one object has passed through said position of alignment, said number of objects being defined by the address code of said one object identifying said specific receptacle and stored in said control means; and transferring means, responsive to a signal issued at said time by said control means when said number of objects has been counted, for transferring said one object from said one station to said one directing means portion, to thereby effect passage of said object to said specific receptacle associated therewith.

2. Apparatus as claimed in claim 1 wherein said transporting means includes an endless second conveyor supported for movement relative to fixed guide means; wherein said stations include distinct containers on said second conveyor for receiving respective ones of said objects in said sequence from said conveying means, via said delivering means, and for carrying said objects successively along said path during said second conveyor movement, each of said containers having an open top and an openable bottom for receiving and releasing, respectively, one of said objects; wherein said container bottom includes an opening and a closure therefor movable to an open position, said closure having an arm extending therefrom and engageable near said fixed guide means for moving said closure to said open position; and wherein said transferring means includes a member movably mounted on said guide means and actuatable toward the one of said containers passing thereby at said time, in response to said signal issued by said control means, to engage said arm and thereby move said closure to said open position.

3. Apparatus as claimed in claim 2 wherein said directing means portions includes a plurality of flexible conduits, each having an open top end coupled to said fixed guide means, at a level beneath said container bottom passing thereby, and an open bottom end disposed above the corresponding one of said receptacles, whereby one of said objects when released from its container is directed to the specific receptacle associated therewith; wherein said second conveyor moves said containers in an advancing direction along said path; wherein each of said containers has a first overall dimension as measured in said advancing direction; wherein one of said receptacles has a second overall dimension as measured in said advancing direction; wherein said second dimension is at least twice said first dimension; wherein a plurality of said receptacles are disposed next to one another in each of a plurality of rows oriented transversely with respect to said advancing direction and succeeding one another longitudinally with respect to said advancing direction; and wherein successive ones of said conduits extend from said fixed guide means respectively first toward successive ones of said receptacles disposed next to one another in one of said rows and then toward successive ones of said receptacles disposed next to one another in each succeeding row.

4. A method for sorting objects bearing indicia of respective destination addresses and for distributing said objects to receptacles associated with said addresses, said method comprising the steps of:

converting each of said indicia into a corresponding address code identifying a specific one of said receptacles;

feeding said address code to electronic control means for storage therein;

conveying said objects, after said feeding said code to said control means, in sequence at uniform intervals through a position of alignment with reading and metering means and thence to object transferring means;

reading each of said indicia when each of said objects is in said position of alignment;

feeding each of said indicia, when read, to said control means for correlation with said corresponding address code stored therein;

counting succeeding ones of said objects when each is in said position of alignment;

transporting said objects from said transferring means in said sequence in uniformly spaced containers along a continuous closed path, said receptacles being successively arranged in object-receiving relationship to said path, each of said receptacles being associatable with any one of said containers;

coordinating said conveying and said transporting so that each of said objects conveyed at said uniform intervals through said position of alignment to said transferring means is associated sequentially with a particular one of said containers, and the number of said objects passing sequentially through said position of alignment equals the number of said containers passing sequentially through an arbitrary metering point along said path, whereby any one of said containers transporting one of said objects along said path reaches a location in object-delivering relationship to the specific one of said receptacles identified by said address code, corresponding to the particular one of said indicia on said one object and stored in said control means, at a time determined by said counting of the number of said objects passing sequentially through said position of alignment after said one object has passed through said position, said number of said objects being defined by said address code; and delivering said one object from said one container at said location to said one receptacle identified by said address code in response to a signal issued at said time by said control means when said number of objects defined by said code has been counted.

5. A method as claimed in claim 4 wherein said delivering step includes opening a bottom portion of said one container in response to said signal, to release said one object for delivery by force of gravity, and guiding that object, upon its release, specifically toward said one receptacle.

* * * * *

UNITED STATES PATENT AND TRADEMARK OFFICE

CERTIFICATE OF CORRECTION

PATENT NO. : 4,567,988

DATED : February 4, 1986

INVENTOR(S) : Clemens Weibel

It is certified that error appears in the above—identified patent and that said Letters Patent is hereby corrected as shown below:

Column 1, line 28, "containing" should read --container--.

Column 2, line 11, "receptables" should read --receptacles--.

Column 2, line 61, "as" should read --are--.

Column 3, line 9, "continous" should read --continuous--.

Column 3, line 23, "storing" should read --sorting--.

Column 3, line 41, "receptable" should read --receptacle--.

Column 4, line 18, "tranversely should read --transversely--.

Column 4, line 48, "recorded" should read --recoded--.

Column 5, line 6, "circuit" should read --conduit--.

Column 5, line 56, "in" should read --to--.

Column 6, line 46, "in" should read --on--.

Column 6, line 59, "passsing" should read --passing--.

UNITED STATES PATENT AND TRADEMARK OFFICE

CERTIFICATE OF CORRECTION

PATENT NO. : 4,567,988

DATED : February 4, 1986

INVENTOR(S) : Clemens Weibel

It is certified that error appears in the above-identified patent and that said Letters Patent is hereby corrected as shown below:

Column 7, line 49, "one" should read -- each --.

Signed and Sealed this

*Sixteenth* Day of *September 1986*

[SEAL]

*Attest:*

DONALD J. QUIGG

*Attesting Officer*

*Commissioner of Patents and Trademarks*